US005678201A

United States Patent [19]

Thill

[11] Patent Number: 5,678,201

[45] Date of Patent: Oct. 14, 1997

[54] ANTENNA ASSEMBLY WITH BALUN AND TUNING ELEMENT FOR A PORTABLE RADIO

[75] Inventor: Kevin M. Thill, Kenosha, Wis.

[73] Assignee: Motorola, Inc., Schaumburg, Ill.

[21] Appl. No.: 595,121

[22] Filed: Feb. 1, 1996

[51] Int. Cl.[6] ..... H01Q 11/08; H01Q 1/36

[52] U.S. Cl. ..... 455/89; 455/121; 455/129; 343/859; 343/895

[58] Field of Search ..... 455/89, 90, 121, 455/123, 129; 343/821, 822, 859, 860, 861, 863, 895; 333/26, 127, 128

[56] References Cited

U.S. PATENT DOCUMENTS

| | | | |
|---|---|---|---|
| 5,349,365 | 9/1994 | Ow et al. | 343/895 |
| 5,628,057 | 5/1997 | Phillips et al. | 343/895 X |

OTHER PUBLICATIONS

"Spacecraft Antennas", Chapter 20, American Radio Relay League, pp. 20–1 to 20–7.

A. Kumar, *Fixed and Mobile Terminal Antennas*, Chapter 5, Artech House, Inc., 1991, pp. 163–236.

*Primary Examiner*—Chi H. Pham

*Attorney, Agent, or Firm*—Daniel W. Juffernbruch

[57] ABSTRACT

Arms (310, 320, 330, 340) of an antenna element are connected to a balanced-unbalanced conversion network (510) at a feed point of excitation to provide an antenna assembly. Characteristics such as size of the antenna assembly are improved by providing a tuning element near connections (610, 620) to a feed point of excitation. The tuning element (410) is electrically connected to one of the arms (330) but is disposed with a gap between a neighboring arm (320). A gap may also be provided between the tuning element (410) and a feed point of excitation. The arms and tuning element are preferably thin metallic arms formed on an elongated dielectric tube (210) in the preferred construction of the invention. The balanced-unbalanced conversion network (510) may also be disposed within the elongated dielectric tube (210) according to the preferred construction.

16 Claims, 5 Drawing Sheets

ANTENNA ASSEMBLY WITH BALUN AND TUNING ELEMENT FOR A PORTABLE RADIO

BACKGROUND OF THE INVENTION

1. Technical Field

This invention relates to antenna assemblies and, more particularly, relates to antenna assemblies with size and performance optimized feed networks.

2. Description of the Related Art

A radio transceiver circuit often has different impedance characteristics than an associated antenna. A radio transceiver circuit often has a different resistance such as 50 Ohms while the antenna may have a 10 Ohm resistance. One of the antenna and radio transceiver circuit often is unbalanced while the other is balanced. The feed line between the antenna could also have a different balanced or unbalanced resistance characteristic or a different resistance in Ohms. For example, a coaxial feed line typically is an unbalanced feed line while a twin lead feed line is typically a balanced feed line.

Balanced-unbalanced conversion networks, or as less formally referred to in the art as baluns, provide for a match of impedance characteristics to match not only the resistance but also convert between balanced and unbalanced inputs and outputs.

When a balun is connected between a feed line and an antenna element to match the impedance characteristics therebetween, the size, weight and complexity of manufacture of the antenna assembly is often increased. As the antenna designer makes advances allowing reduction in size or diameter of the antenna element itself, the balun becomes the limiting constraint prohibiting further size reduction.

DETAILED DESCRIPTION OF THE PREFERRED EMBODIMENTS

Tuning elements are provided at the feed point of excitation of arms of an antenna to allow use of smaller size and different configuration balanced-unbalanced conversion networks (baluns). A balanced-unbalanced conversion network is connected between an unbalanced feed line and a balanced feed point of excitation. A tuning element augments an arm of the antenna at the feed point of excitation. By providing the tuning element at this location, characteristics such as size of the balanced-unbalanced conversion network are improved. The size of a balanced-unbalanced conversion network (balun) is thus no longer a constraint on the size of an antenna assembly. Because the size of the balun can be reduced, the balun no longer needs to be the largest component of an antenna assembly. Antennas of reduced diameter were not heretofore possible without the tuning elements placed according to the present invention because the required balanced-unbalanced conversion network would have been larger than the diameter of the antenna itself. Such constraint on reduction in antenna assembly size is removed by the present invention.

The tuning elements also give the pattern of the antenna improved pattern characteristics. A more perfectly symmetrical hemispherical antenna pattern is achieved. It has been found that with the tuning element arranged in the antenna assembly according to the present invention, a cusp in the input impedance versus frequency relationship of the antenna can be easily created. This cusp causes the antenna pattern to be more perfectly hemispherical. Satellites communicate with portable radios on the earth at various elevation angles from the horizon to the zenith. Better uniform performance of a portable satellite radio is achieved in the present invention over these elevation angles from the horizon to the zenith.

Figure 1:
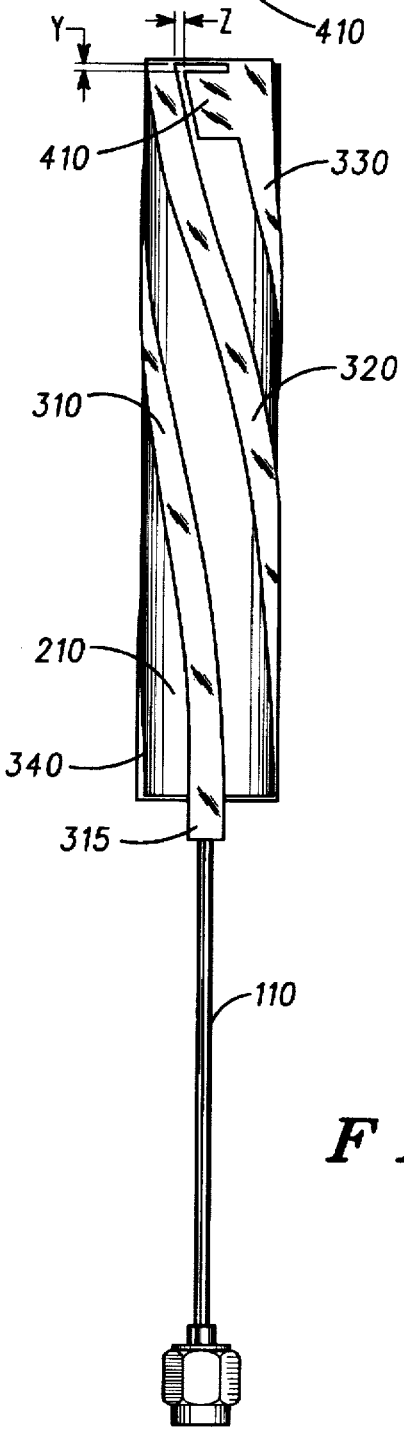
FIG. 1 illustrates a plan view of a right side of the antenna assembly.

FIG. 1 illustrates an antenna assembly fed by an unbalanced feed line 110. The unbalanced feed line 110 feeds a balun (not shown) disposed inside of a dielectric tube 210. Four arms 310, 320, 330 and 340 are plated on the dielectric tube 210. Each of the four arms 310, 320, 330 and 340 connect to the balun at a feed point of excitation at the top of the dielectric tube 210. A tuning element 410 is electrically connected to one of the four arms 330, but spaced from a neighboring other of the thin metallic arms 320 by a distance Z. The tuning element 410 is also spaced from the feed point of excitation at the top of the dielectric tube 210 by a distance Y. The arms 310, 320, 330 and 340 and the tuning element 410 are preferably plated onto the dielectric tube 210.

Figure 2:
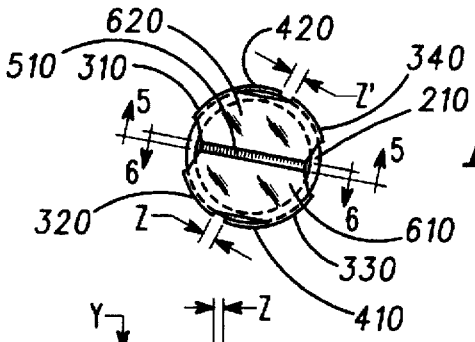
FIG. 2 illustrates a top end view of the antenna assembly of FIG. 1.

FIG. 2 illustrates a top view of the right side view of the antenna assembly of FIG. 1. The feed point of excitation is provided by two connections 610 and 620. Thin metallic arms 310, 320, 330 and 340 connect to a top edge 510 of the balun via the two connections 610 and 620 for the feed point of excitation. Tuning elements 410 and 420 are also illustrated in FIG. 2.

Figure 4:
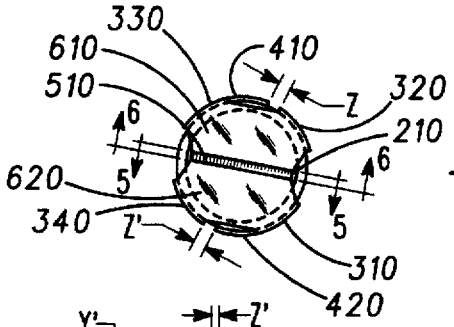
FIG. 4 illustrates a top end view of the antenna assembly of FIG. 3.
Figure 3:
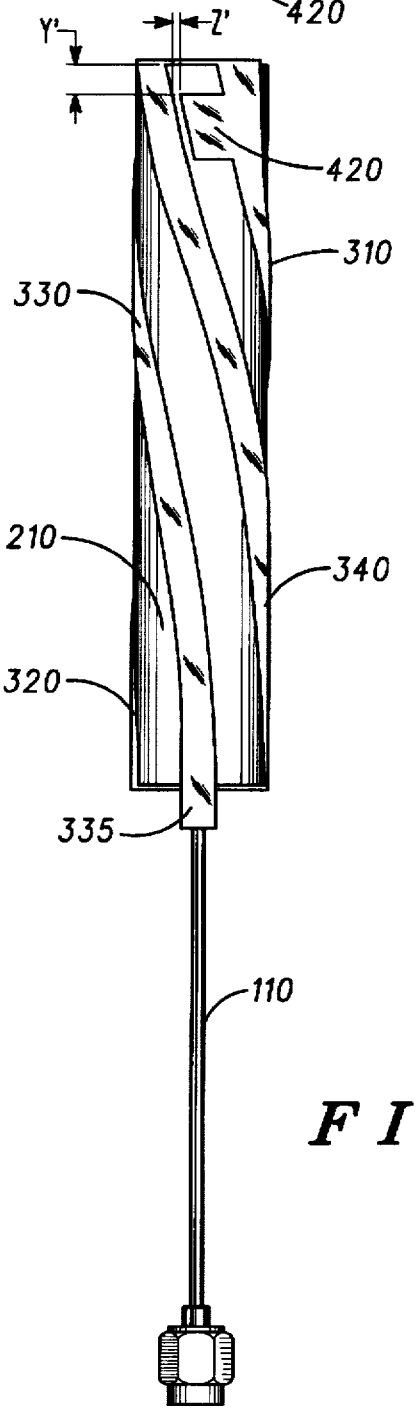
FIG. 3 illustrates a plan view of a left side of the antenna assembly.

FIG. 3 illustrates a left side view of the antenna assembly of FIGS. 1 and 2, and FIG. 4 illustrates a top end view of the left side view of the antenna assembly of FIG. 3. Tuning element 420 is preferably a thin metallic tuning tab plated to the dielectric tube 210. Both of the tuning elements 410 and 420 have the same height in the preferred embodiment of about 0.6477 centimeters (0.255 inches) and the same width of about 0.2677 centimeters (0.105 inches). The dielectric tube 210 in the preferred embodiment extends about a longitudinal axis and has an inside diameter of about 0.635 centimeters (0.250 inches) and an outside diameter of about 0.8128 centimeters (0.320 inches). The second tuning element 420 is electrically connected to one of the arms 310 but spaced a distance Z' from a neighboring arm 340. The second tuning element 420 is also spaced from the feed point of excitation at the top of the dielectric tube 210 by a distance Y'. The distance Y' is a different distance Y' for the second tuning element 420 than the distance Y for the first tuning element 410 is preferred for the balun in the following example which will be further discussed later with reference to the cross-sectional views in FIGS. 5 and 6.

The dimensions of X, Y and Z in FIGS. 1, 3, 5 and 6 are chosen to provide a desired impedance characteristic at the input to the antenna arms when looking from the feed point of excitation. The dimension Z forms a gap greater than zero. The gap in the preferred embodiment has a dimension Z of about 0.508 millimeters (0.020 inch). The dimension Y can be greater than or can be equal to zero. The dimension Y in the preferred embodiment is about 0.381 millimeters (0.015 inch). The dimension X is preferably the inside diameter of the dielectric tube 210 to reduce the size of the tuning element 410, but could be smaller. The dimension X in the preferred embodiment is about 0.635 centimeters (0.250 inch).

Besides a tube of round shape, an oval, elliptical, octagonal, square, rectangular or other like shape can be used to provide an elongated dielectric surface circumscribing a longitudinal axis. What is important for manufacturability is that the arms have a supporting surface that coexists along three orthogonal axes to provide for an antenna capable of transceiving a circularly polarized radio field. Instead of thin metallic arms and a thin metallic tuning element disposed on a dielectric substrate, free standing wire arrangements may be used to implement the antenna assembly of the present invention.

The thin metallic arms 310, 320, 330 and 340 in the preferred embodiment each have a width of about 0.3175 centimeters (0.125 inches), the shorter two thin metallic arms 320 and 340 have a length measured along the tube to the bottom of the tube of about 8.0264 centimeters (3.16 inches) and the longer two thin metallic arms 310 and 330 have a length measured along the tube to the ends of the folds 315 and 335 of about 8.5344 centimeters (3.36 inches). While the arms 310, 320, 330 and 340 and thin metallic tuning elements 410 and 420 are preferably plated onto the dielectric tube 210, the thin metallic arms and the thin metallic tuning elements 410 and 420 can alternatively be glued to the dielectric tube 210.

The antenna in the example of the preferred embodiment uses a quadrifilar helix antenna element. The quadrifilar helix antenna element has two pairs of arms among the four arms 310, 320, 330 and 340—causing a total of four arms. One of the pair of arms 310 and 330 has a longer length than the other of the pair of arms 320 and 340. The longer length is accommodated by folded extensions 315 and 335 at the bottom of the dielectric tube 210 a shown in FIGS. 1 and 3. This allows the longer of the pairs of arms to be inductive, e.g., 50+j50 Ohms and the shorter of the pair of arms to be capacitive, e.g., 50−j50 Ohms. Thus, when the pair of arms are fed in parallel, the resulting input impedance is purely resistive and a quadrature current relationship exists between the arms of the antenna. As a result of this phenomena, the antenna has a circularly polarized field. Both quadrifilar antenna elements (twisted crossed loop antenna elements) and crossed loop antenna elements have two pairs of arms. Each pair of arms makes a loop. The loops are perpendicular to one another in a crossed relationship in a crossed loop antenna element. In a twisted crossed loop antenna element, the crossed loops are also twisted to form a quadrifilar helix antenna element.

The portable satellite radio of the present invention has a more uniform antenna pattern over the elevation angles from the horizon to the zenith. It has been found that with the tuning element arranged in the antenna assembly according to the present invention, a cusp in the input impedance versus frequency relationship of the antenna can be easily created. When the input impedance forms a cusp, in the above examples of self phased antennas, a quadrature current relationship will result between the arms of the antenna element—producing a more perfectly formed circularly polarized antenna pattern.

Figure 5:
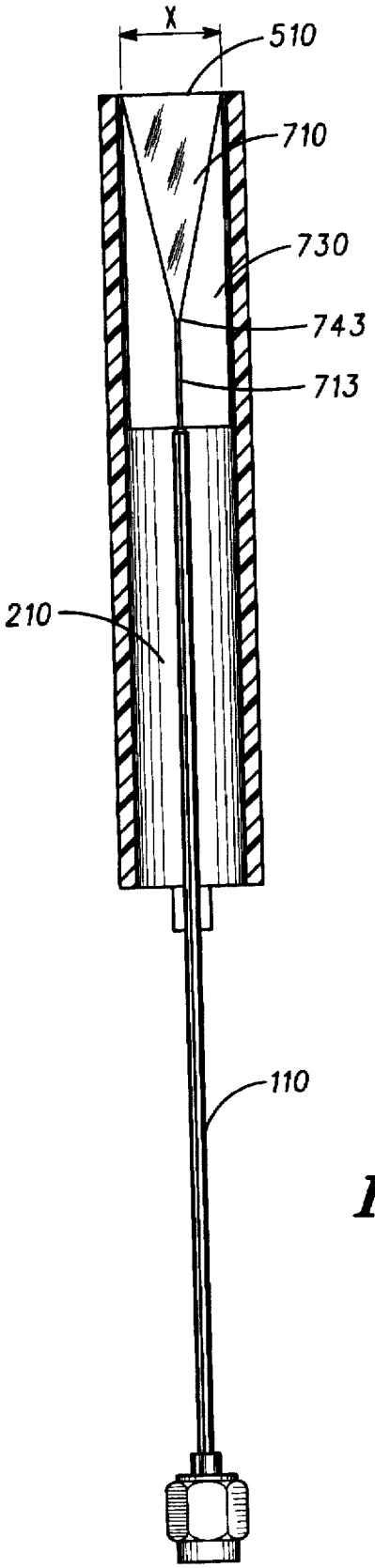
FIG. 5 illustrates a cross-sectional view of the antenna assembly of FIGS. 1–4 taken along line 5—5.
Figure 6:
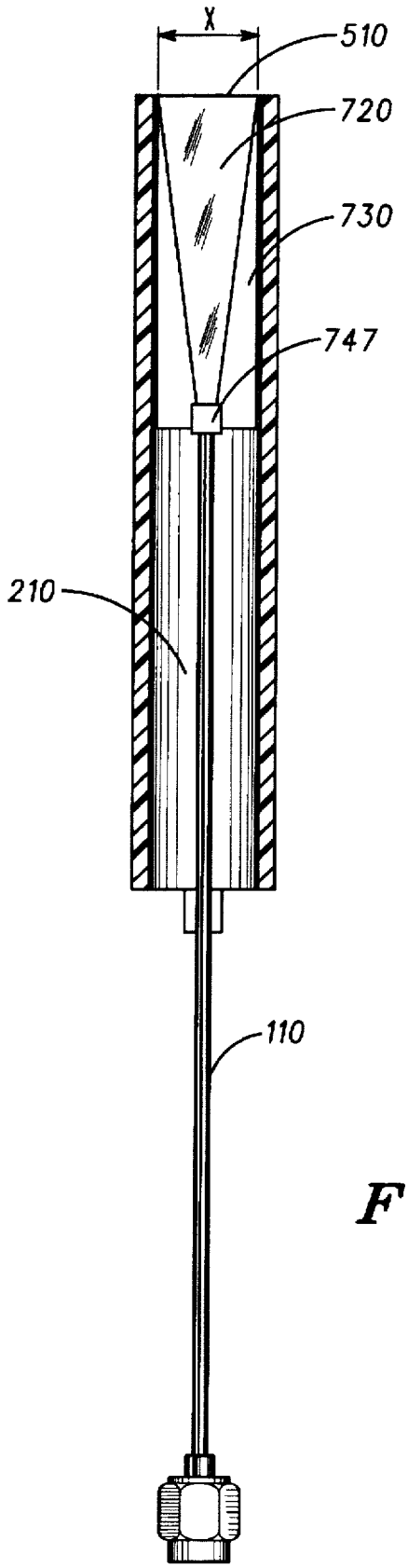
FIG. 6 illustrates a cross-sectional view of the antenna assembly of FIGS. 1–4 taken along line 6—6.

FIGS. 5 and 6 illustrate cross-sectional views of the antenna assembly of FIGS. 1–4 taken along respective lines 5—5 and 5–6. FIGS. 5 and 6 illustrate respective front and back surfaces of a balun connected between feed line 110 and a feed point of excitation at a top end 510 of the balun. In the example of FIGS. 5 and 6, a tapered balun is illustrated. This tapered balun is preferably built using tapered microstrips 710 and 720 plated on a dielectric planer member 730 as illustrated in the two views of FIGS. 5 and 6. An inner coaxial conductor of the feed line 110 connects to the tip of the tapered microstrip at narrow end point 743 and an outer conductor of the feed line 110 connects to a tapered end of the other tapered microstrip 720 at a tapered end 747. A microstrip transmission line has a active line and an opposing ground plane. The ground plane must be wider than the active line. The microstrip 720 of the tapered balun is wider at the tapered end 747 to ensure the start of a true ground plane for the resulting transmission line of the microstrips 710 and 720. The tapered microstrip 710 consists of a tapered portion above point 743 and a linear portion 713 below point 743 in FIG. 5.

The tapered balun of the preferred embodiment of the present invention has a dielectric planer member of about 0.635 centimeters (0.250 inch) in width, of about 2.159 centimeters (0.850 inches) in length and of about 0.0635 centimeters (0.025 inches) in thickness. The shorter tapered portion of the microstrip 710 of the balun of the preferred embodiment has a height of 1.651 centimeters (0.650 inch). The taller tapered microstrip has the same height as the dielectric planar member 730.

Other types of baluns may be used besides the exemplary tapered balun such as bazooka baluns, split sheath baluns and fish hook baluns. The bazooka and split sheath baluns would work but would require matching capacitors, otherwise the desired return loss characteristics could not be achieved and still maintain a practical size. With the fish hook balun, a practical size would be more difficult to achieve. In some size instances the width of the fish hook balun would be impractical because it would be bigger the supported antenna element to match to the impedance of a feed line.

Figure 7:
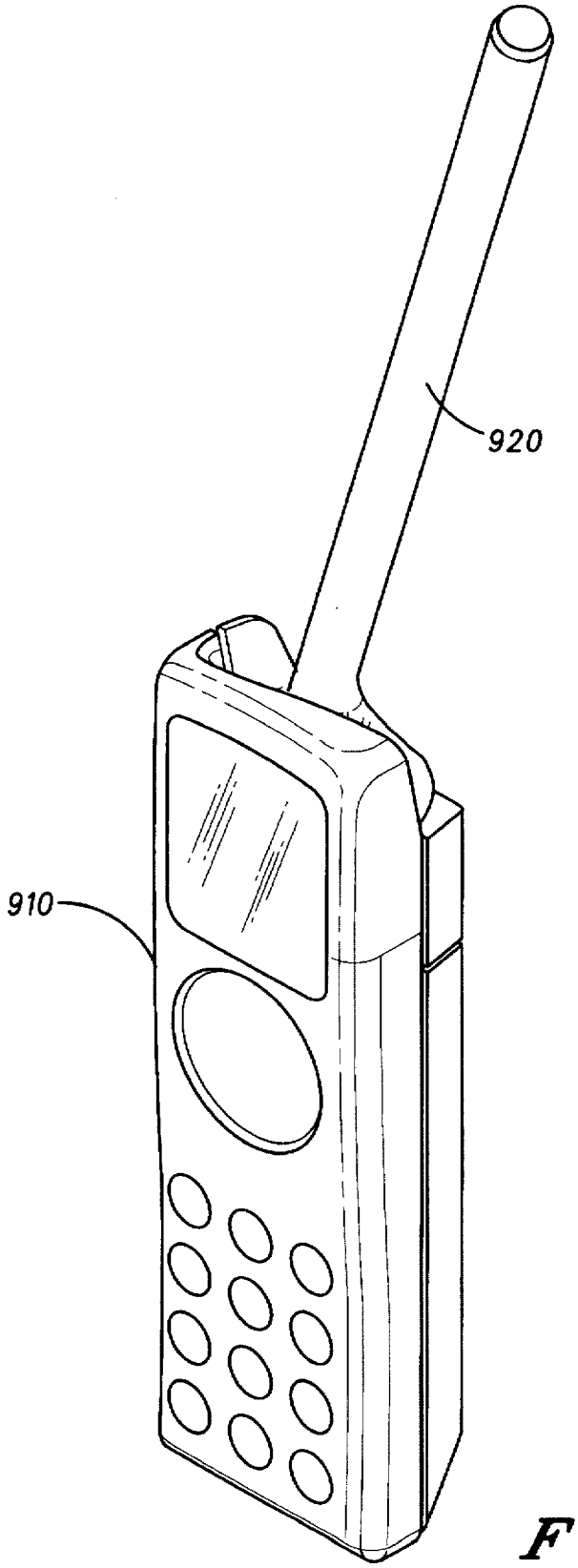
FIG. 7 illustrates a portable radio according to the present invention.

FIG. 7 illustrates a portable radiotelephone transmitter 910 having an antenna assembly 920 connected thereto at a pivot point. Better uniform performance of a portable satellite radio is achieved by the present invention over the elevation angles of a satellite from the horizon to the zenith, while still maintaining a small size antenna assembly.

Although the invention has been described and illustrated in the above description and drawings, it is understood that this description is by example only and that numerous changes and modifications can be made by those skilled in the art without departing from the true spirit and scope of the invention. The present invention is applicable to analog as well as digital voice, data or paging satellite systems. The present invention is also applicable to terrestrial antennas for portable radios requiring small antennas and uniform patterns. While the present invention has size advantages for a portable radio, the present invention also has advantages for fixed and mobile radios.

What is claimed is:

1. An antenna assembly, said antenna assembly comprising:

a balanced-unbalanced conversion network operatively connected between an unbalanced antenna feed and a balanced feed point of excitation;

a first and second pairs of arms having a crossed relationship with one another and operatively connected to the balanced-unbalanced conversion network at the feed point of excitation; and a tuning element at the feed point of excitation of a corresponding pair of arms and operatively connected to the balanced-unbalanced conversion network and one of the pairs of thin metallic arms with a gap between the tuning element and the other of the pair of arms sufficient to maintain a matched conversion.

2. An antenna assembly according to claim 1, wherein the antenna assembly further comprises an elongated dielectric surface circumscribing a longitudinal axis; and wherein the first and second pairs of arms each comprise first and second pairs of thin metallic arms formed on the elongated dielectric surface in a crossed relationship with one another and operatively connected to the balanced-unbalanced conversion network at respective first and second feed points of excitation.

3. An antenna assembly according to claim 2, wherein the tuning element comprises a thin metallic tuning tab formed on the elongated dielectric surface.

4. An antenna assembly according to claim 3, wherein the balanced-unbalanced conversion network is formed of opposing first and second microstrips having first and second narrow ends and first and second wide ends, the first and second narrow ends operatively connected to the unbalanced antenna feed and the first and second wide ends operatively connected to respective balanced first and second feed points of excitation, wherein the gap has dimensions sufficient to reduce the width of the balanced-unbalanced conversion network and still maintain a matched conversion.

5. An antenna assembly according to claim 3, wherein the balanced-unbalanced conversion network is disposed behind the elongated dielectric surface opposite the balanced feed point of excitation.

6. An antenna assembly according to claim 2, wherein the balanced-unbalanced conversion network is disposed within the elongated dielectric surface.

7. An antenna assembly according to claim 1, wherein each pair of arms forms a loop.

8. An antenna assembly according to claim 1, wherein each pair of arms forms a twisted loop.

9. An antenna assembly according to claim 8, wherein two of the twisted loops are disposed in a crossed relationship to form a quadrifilar helix antenna element.

10. An antenna assembly according to claim 1, wherein the at least two pairs of arms is composed of two crossed loops forming a crossed loop antenna element.

11. An antenna assembly, said antenna assembly comprising:

an elongated dielectric surface circumscribing a longitudinal axis;

a balanced-unbalanced conversion network operatively connected between an unbalanced antenna feed and a balanced feed point of excitation;

a first and second pairs of thin metallic arms formed on the elongated dielectric surface in a crossed relationship with one another and operatively connected to the balanced-unbalanced conversion network at the feed point of excitation; and a tuning element formed on the elongated dielectric surface at the feed point of excitation of a corresponding pair of thin metallic arms and operatively connected to the balanced-unbalanced conversion network and one of the pairs of thin metallic arms with a gap between the tuning element and the other of the pair of thin metallic arms sufficient to maintain a matched conversion.

12. An antenna assembly according to claim 11, wherein the balanced-unbalanced conversion network is disposed behind the elongated dielectric surface opposite the balanced feed point of excitation.

13. An antenna assembly according to claim 12, wherein the elongated dielectric surface comprises a tubular dielectric and wherein the balanced-unbalanced conversion network is disposed within the tubular dielectric.

14. An antenna assembly according to claim 11, wherein the tuning element is a thin metallic tuning tab formed on the elongated dielectric surface.

15. An antenna assembly, said antenna assembly comprising:

an elongated dielectric surface circumscribing a longitudinal axis;

a balanced-unbalanced conversion network disposed within the elongated dielectric surface and formed of opposing first and second microstrips having first and second narrow ends and first and second wide ends, the first and second narrow ends operatively connected to an unbalanced antenna feed and the first and second wide ends operatively connected to respective balanced first and second feed points of excitation;

a first and second pairs of thin metallic arms formed on the elongated dielectric surface in a crossed relationship with one another and operatively connected to the balanced-unbalanced conversion network at respective first and second feed points of excitation; and a thin metallic tuning tab formed on the elongated dielectric surface at the feed point of excitation of a corresponding pair of thin metallic arms and operatively connected to a corresponding wide portion of the balanced-unbalanced conversion network and forming one of the pairs of thin metallic arms with a gap between the thin metallic tuning element and the other of the pair of thin metallic arms sufficient to reduce the width of the wide portion of the balanced-unbalanced conversion network and still maintain a matched conversion.

16. A portable radio, comprising:

a balanced-unbalanced conversion network operatively connected between an unbalanced antenna feed and a balanced feed point of excitation;

a first and second pairs of arms having a crossed relationship with one another and operatively connected to the balanced-unbalanced conversion network at the feed point of excitation;

a tuning element at the feed point of excitation of a corresponding pair of arms and operatively connected to the balanced-unbalanced conversion network and one of the pairs of thin metallic arms with a gap between the tuning element and the other of the pair of arms sufficient to maintain a matched conversion; and radio transceiver circuitry operatively coupled to the unbalanced antenna feed.

* * * * *